US005562225A

United States Patent [19]

McKenna

[11] Patent Number: 5,562,225

[45] Date of Patent: Oct. 8, 1996

[54] COLLAPSIBLE STORAGE ASSEMBLY

[76] Inventor: Timothy J. McKenna, 2311 A La Casa, Austin, Tex. 78704

[21] Appl. No.: 434,346

[22] Filed: May 2, 1995

[51] Int. Cl.[6] ..... B65D 33/02

[52] U.S. Cl. ..... 220/9.1; 220/9.3

[58] Field of Search ..... 217/65, 38; 220/9.1, 220/9.2, 9.3

[56] References Cited

U.S. PATENT DOCUMENTS

| | | | |
|---|---|---|---|
| 694,289 | 2/1902 | Langston | 220/9.2 |
| 2,014,904 | 9/1935 | Martin | 220/9.3 |
| 2,502,323 | 3/1950 | Jackson | 220/9.3 |
| 2,524,352 | 10/1950 | Kiser | 220/9.1 |
| 3,286,752 | 11/1966 | Duryee, Jr. | 220/9.3 |
| 4,646,802 | 3/1987 | Basore et al. | 220/9.3 |

FOREIGN PATENT DOCUMENTS

| | | | |
|---|---|---|---|
| 11600 | of 1914 | United Kingdom | 220/9.3 |

*Primary Examiner*—Stephen J. Castellano
*Attorney, Agent, or Firm*—Skjerven, Morrill, MacPherson, Franklin & Friel; Kent B. Chambers

[57] ABSTRACT

A storage assembly having a frame which in one embodiment includes frame support members, transverse members pivotally attached to corresponding frame support members, and cross-members spanning between frame support members and between transverse members, and having a removable object retainer such as a pouch suspended within the frame. In one embodiment, the storage assembly also includes locking hinges coupled between corresponding frame and transverse members. The locking hinges allow the storage assembly to be expanded and remain opening when extraneous items are inserted into the pouch. The storage assembly includes attachment member to conveniently attach the storage assembly near to the user. For example, the storage assembly may be attached to a director's chair. The storage assembly conveniently holds extraneous items and assists in protecting the items from damage. The storage assembly may be easily unattached from an object and closed so as to occupy minimal space during non-use.

18 Claims, 3 Drawing Sheets

COLLAPSIBLE STORAGE ASSEMBLY

FIELD OF THE INVENTION

This invention relates to storage assemblies and particularly to storage assemblies which may be removably attachable to other objects.

BACKGROUND

When participating in various activities, such as camping, sun bathing, fishing, and other indoor and outdoor activities, various extraneous items are utilized. Often when participating in such activities the participants sit in chairs, for example, in a portable, collapsible wood and cloth director's type chair ("director's chair"). The extraneous items, such as drinks, books, sunscreen, cigarettes, flash lights, and lighters, are often inconveniently placed in a detached storage assembly such as a cooler, or they are left unprotected on a surface such as a table, a patio, a pier, or the ground. As a result, the extraneous items are often not readily available and may be lost, spilled, or damaged.

Storage assemblies are often used to hold a variety of items that would otherwise be strewn about. Additionally, although various storage assemblies exist, often they are not portable, inconveniently located, and/or occupy the same amount of space whether in use or not.

SUMMARY OF THE INVENTION

The present invention is a storage assembly having a frame structure which supports an object retainer. The storage assembly may be equipped with attaching features such as brackets, hooks, clamps, and other fastening devices to attach the storage assembly to a variety of objects, for example, to director's chairs. In one embodiment, the storage assembly includes a pair of frame support members and a pair of transverse members pivotally attached to respective frame support members to provide a collapsible storage assembly which when collapsed advantageously occupies minimal space when not in use. In this embodiment, structural motion limiters such as a locking hinge are coupled to corresponding frame and transverse members to brace the storage assembly when in an open position.

In another embodiment the object retainer is a flexible pouch which is easily removable for storage and cleaning. The pouch is made of any of a variety of materials, for example, coordinating fabric with a director's chair fabric. In another embodiment, the present invention is a wooden frame having a removably attached storage pouch with fastening devices for removably attaching the frame to the arm of a director's chair.

BRIEF DESCRIPTION OF THE DRAWINGS

Reference numerals referring to the same feature appearing in multiple figures are the same.

DETAILED DESCRIPTION

The following description is intended to be illustrative only and not limiting.

Figure 1:
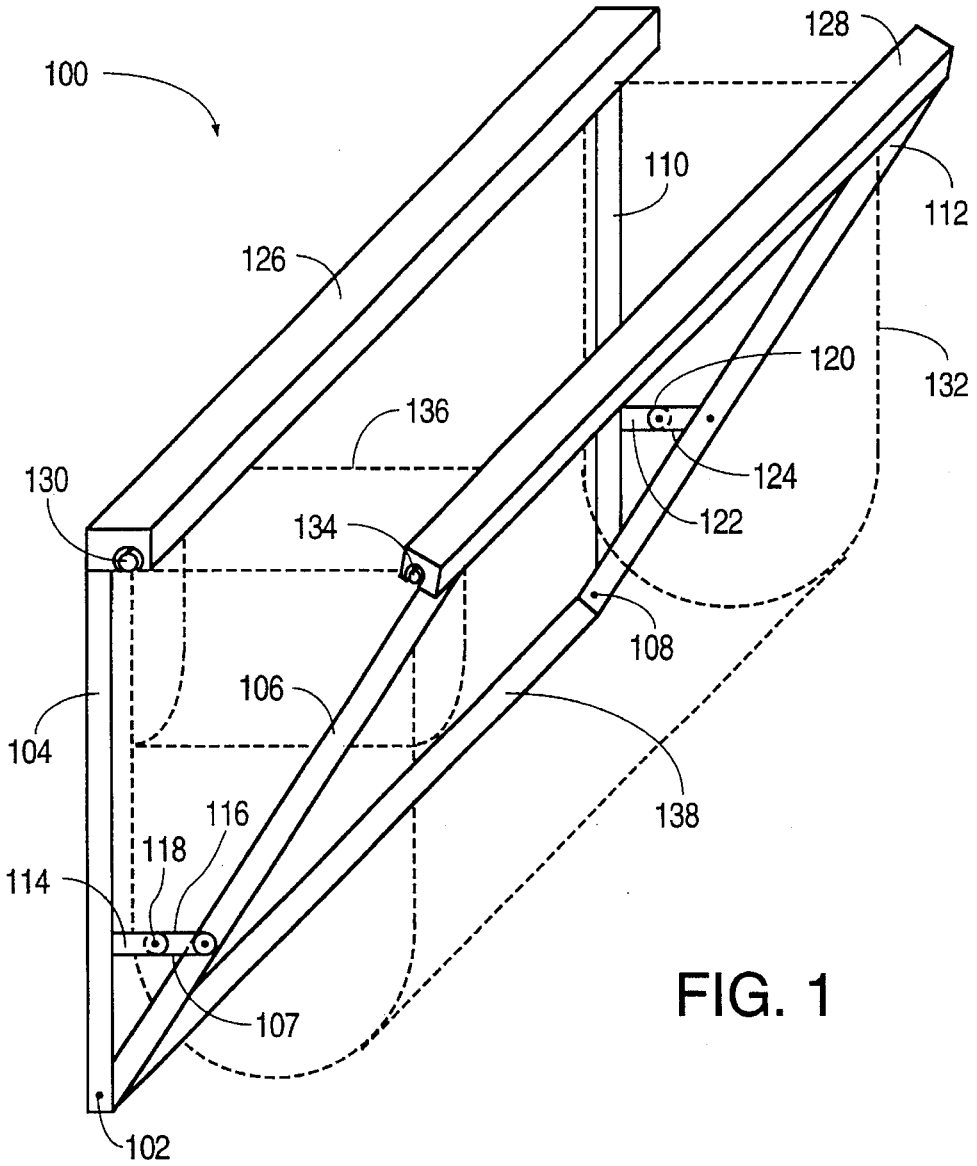
FIG. 1 is a perspective view of a frame and pouch collapsible storage assembly.

Referring to FIG. 1, an installable and easily removable frame and pouch collapsible storage assembly ("storage assembly") 100 is illustrated. Metal pivot pin 102 pivotally couples the inside of frame support member 104 to the outside of transverse member 106. The pivotal attachment of frame support member 104 to transverse member 106 allows frame support member 104 and transverse member 106 to rotate with respect to each other and collapse or close to an approximately aligned position. The pivot pin may be a lag bolt and nut, a rivet, or any other suitable attachment structure.

Locking hinge 107 includes a first bracing member 114 coupled to the inside of frame support member 104 and a second bracing member 116 coupled to the outside of transverse member 106. Bracing members 114 and 116 are pivotally coupled at respective end regions with a rivet 118. Bracing member 114 includes a tab extending from a top surface which is received in a corresponding slot in bracing member 116 when brace members 114 and 116 are rotated approximately 180 degrees from each other into a locked position. Other structures may be used to lock bracing members 114 and 116 such as opposing tabs and corresponding slots on each bracing member 114 and 116. Locking hinges 107 and 120 may be made of any suitable rigid material such as iron, stainless steel, brass, other metals, or wood.

Pivot pin 108 pivotally couples the inside of frame support member 110 to the outside of transverse member 112. The pivotal attachment of frame support member 110 to transverse member 112 allows frame support member 110 and transverse member 112 to rotate with respect to each other and close to an aligned position. Locking hinge 120 includes brace members 122 and 124 and is preferably identical in form and function to locking hinge 107.

A plastic bushing 402 (FIG. 4) having a length slightly greater than the combined widths of bracing members 114 and 116 is placed around pivot pin 102 to allow frame support member 104 and transverse member 106 to close without interference or binding. Bushing 402 may also be made of other suitable materials such as metal. A bushing 404 (FIG. 4), preferably identical to bushing 402, is placed around pivot pin 108 to allow frame support member 110 and transverse member 112 to likewise close without interference.

Storage assembly 100 further includes cross-member 126 spanning between frame support members 110 and 114 and having bottom end surface portions fixedly attached to top surfaces of frame support members 110 and 114, respectively. A second cross-member 128 spans between transverse members 106 and 112 and includes bottom end surface portions fixedly attached to top surfaces of transverse members 106 and 112. A third cross-member 138 spans between the junction of transverse member 106 and frame support member 104 and the junction of transverse member 112 and frame support member 110 and includes end surface portions fixedly attached to respective inside lower surfaces of transverse members 106 and 112. Cross-members 126, 128 and 138 are fixedly attached to respective members using, for example, glue, screws, nails, dove tail joints, mortise and tenon joints, or other fastening means alone or in combination.

Cross-member 126 includes an omega shaped (Ω-shaped) converging arc conduit extending longitudinally through cross-member 126 to support a dowel rod 130. Dowel rod 130 is inserted through a sleeve in pouch 132 to assist in supporting pouch 132. Cross-member 128 also includes an Ω-shaped converging are conduit extending longitudinally through cross-member 128 to support a dowel rod 134. Dowel rod 134 is inserted through a sleeve in pouch 132 to provide further support for pouch 132.

Frame support member 104 is a ¾×¾×7½ inch wooden beam, and frame support member 110 is a ¾×¾×7½ inch wooden beam. Transverse member 106 is a ¾×¾×10 inch wooden beam, and transverse member 112 is a ¾×¾×10 inch wooden beam. Cross-member 126 is a 1×1½×12 inch wooden beam, and cross-member 128 is a 1×1½×10½ inch wooden beam. Dowel rod 130 is 12 inches long and has a diameter of ¼ inches, and dowel rod 134 is 12 inches long and has a diameter of ¼ inches. Although frame support members 104 and 110, cross-members 126 and 128, and dowel rods 130 and 134 are preferably made of wood, they can also be made of any other suitable rigid material such as plastic, aluminum, stainless steel, and other metals and alloys. When other materials are used, the attachment means may be varied as well such as casting rigidly attached frame support members and cross-members or welding members together.

FIG. 1 illustrates pouch 132 in hidden lines suspended within the flamed structure of storage assembly 100. The pouch 132 may be made of any suitable material such as cotton or nylon and has a size that fits between the plane generally defined by frame support member 104 and transverse member 106 and the plane generally defined by frame support member 110 and transverse member 112. The pouch 132 may have a variety of shapes. Various extraneous items may be stored in the pouch 132 in order to protect them from damage and to store them for convenient retrieval. Various features such as pocket 136 may be incorporated into the pouch 132 to provide a separate storage capability for a specific item such as a canned drink.

Storage assembly 100 may be closed or collapsed by applying a sufficient amount of force to the underside of locking hinges 107 and 120 and bringing cross-members 126 and 128 to a substantially aligned position. The collapsible feature of storage assembly 100 allows it to occupy minimal space when not in use.

Figure 2:
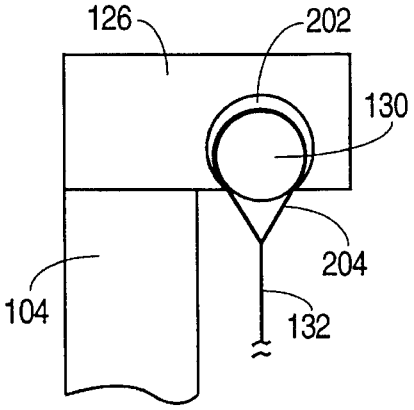
FIG. 2 is a side view of a cross-member, partial frame support member, pouch support dowel, and pouch sleeve.

FIG. 2 illustrates a side view of cross-member 126 having a portion of the bottom surface attached to frame support member 104. An interior portion of cross-member 126 includes the Ω-shaped converging arc conduit 202 through which dowel 130 is inserted. The sleeve 204 is constructed by draping over a top portion of pouch 132 and sewing a seam.

Figure 3:
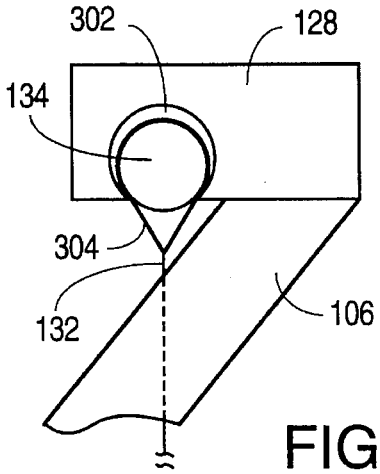
FIG. 3 is a side view of a cross-member, partial transverse member, pouch support dowel, and pouch sleeve.

FIG. 3 illustrates a side view of cross-member 128 having a portion of the bottom surface attached to transverse member 106. An exterior portion of cross-member 128 includes the Ω-shaped converging arc conduit 302 through which dowel 134 is inserted. The sleeve 304 is identical to sleeve 204 (FIG. 2).

The pouch 134 can be easily removed for cleaning, replacement, storage, or for any other reason by simultaneously sliding dowels 130 and 134 out of conduits 202 and 302, respectively, and sleeves 204 and 304, respectively. To remove dowels 130 and 134, an object (not shown) such as a small shaft is inserted against an end of one of the dowels 130 and 134. The dowels 130 and 134 are respectively pushed lengthwise through the end openings in conduits 202 and 302 to expose a graspable end region. The remainder of the respective dowels 130 and 134 is subsequently grasped and pulled from the respective conduits 202 and 302.

Figure 4:
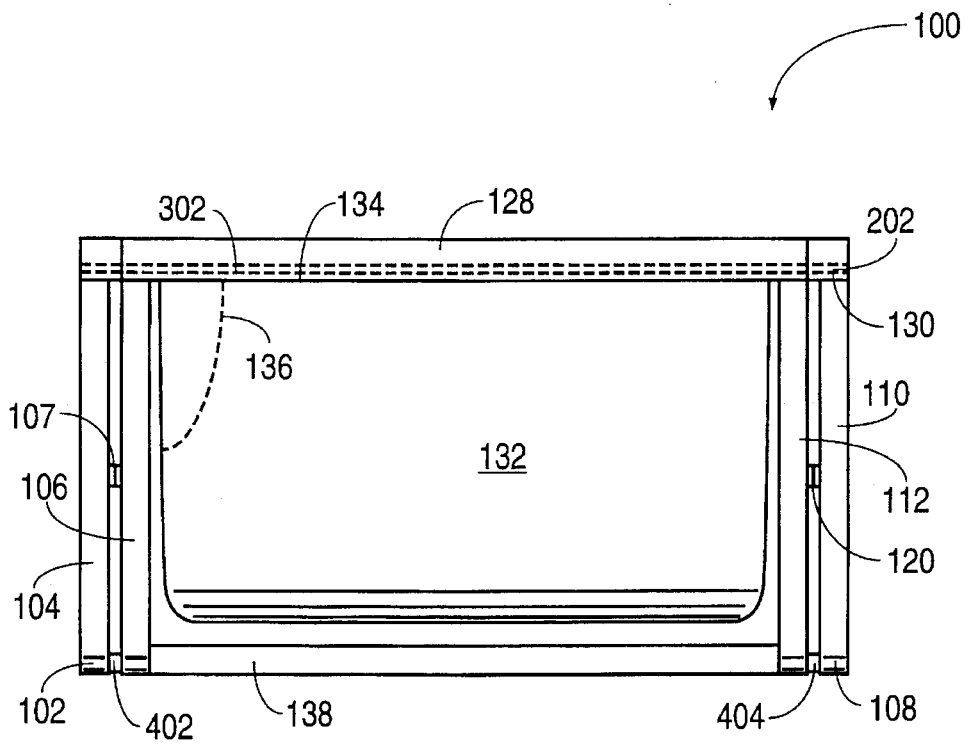
FIG. 4 is a front view of the frame and pouch storage assembly of FIG. 1.

Referring to FIG. 4, the storage assembly 100 is shown in an expanded or open position from the front. The pouch 132 lateral dimension is preferably slightly narrower than the shortest distance between transverse members 106 and 112 to allow the storage assembly to close without interference with pouch 132. The depth of pouch 132 is preferably approximately the same as the length of frame support members 104 and 110. The dimensions of pouch 132 may be varied to accommodate a variety of extraneous items.

Figure 5:
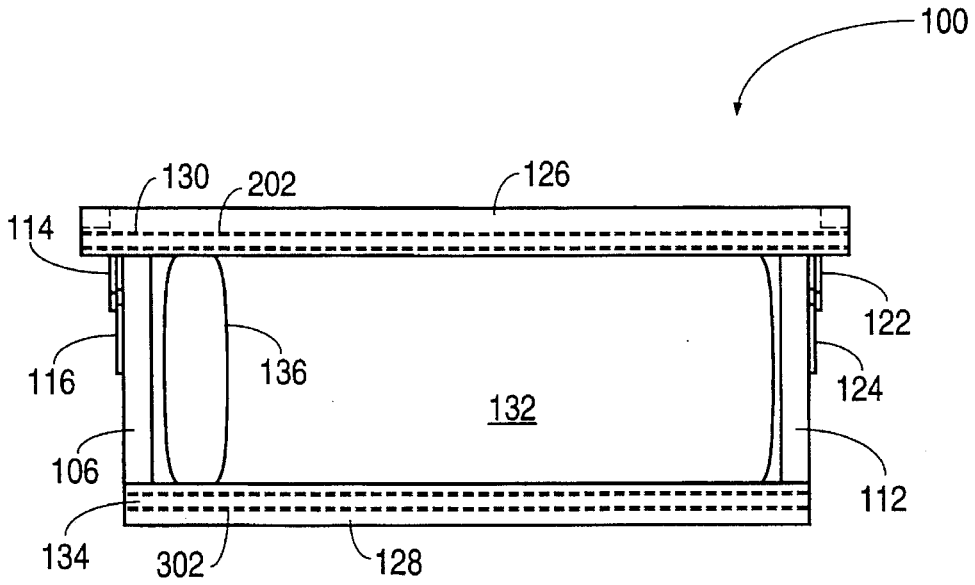
FIG. 5 is a top view of the frame and pouch storage assembly of FIG. 1.

Referring to FIG. 5, the storage assembly 100 is shown from a top view in an open position. Pouch 132 is shown with pocket 136 sewn near the periphery of pouch 132. Various other sizes of pockets, sleeves, and other features may be incorporated into pouch 132. The mouth of the pouch measures approximately 10×7 inches.

Figure 6:
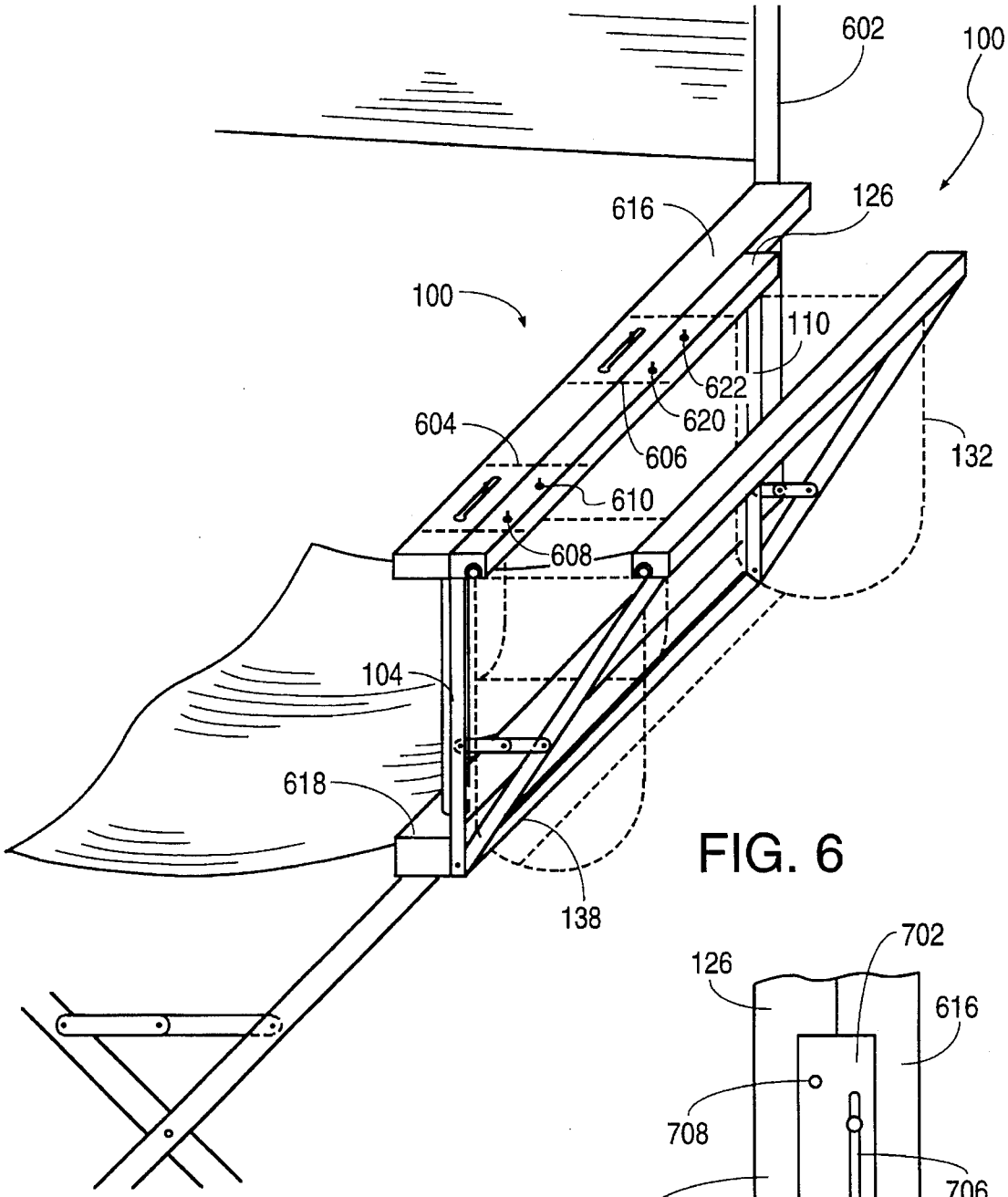
FIG. 6 is the frame and pouch storage assembly removably attached to a director's chair.

FIG. 6 illustrates storage assembly 100 removably attached to a director's chair 602. To attach the storage assembly 100 to the director's chair, two flat two and one-half inch long key-hole brackets 604 and 606 are attached to the back side of cross-member 126 opposite dowel 130. Brackets 604 and 606 are centered approximately 3 inches from respective ends of cross-member 126. Through holes in bracket 604 and 606 are spaced approximately ⅜ of an inch from respective ends of brackets 604 and 606, respectively. Brackets 604 and 606 are flushly attached to cross-member 126 by inserting flat head screws 608 and 610 and flat head screws 620 and 622 through respective through holes and into respective countersunk holes in cross-member 126.

The brackets 604 and 606 include a key-hole cutout with a key-hole arch and channel. Screws 612 and 614, having respective head diameters less than the key-hole arch diameter and greater than the key-hole channel width, are attached to the underside of chair arm 612. The distance between head bases of screws 612 and 614 and arm 616 is only slightly more than the thickness of brackets 604 and 606, respectively. Screws 612 and 614 are spaced approximately six inches apart which corresponds to the same distance between the key-hole arches of brackets 604 and 606.

To install storage assembly 100 on chair 602, the key-hole arches of brackets 604 and 606 are aligned with screws 612 and 614. The heads of screws 612 and 614 are inserted through the key-hole arches of brackets 604 and 606, respectively. Storage assembly is moved forward so that the underside of arm 616 engages one side of brackets 604 and 606 and the head bases engage the other side of brackets 604 and 606, respectively, proximate to respective channel ends of brackets 604 and 606. The end regions of frame support members 104 and 110 opposite cross member 126 rest against chair cross-member 618 to provide rotational stability for storage assembly 100.

To remove storage assembly 100 from chair 602, the key-hole arches of brackets 604 and 606 are moved in the direction of screws 612 and 614 to align the key-hole arches of brackets 604 and 606 with the heads of screws 612 and 614. Storage assembly 100 can now be separated from chair 602 by moving the keyhole arches of brackets 604 and 606 over the heads of screws 612 and 614.

Figure 7:
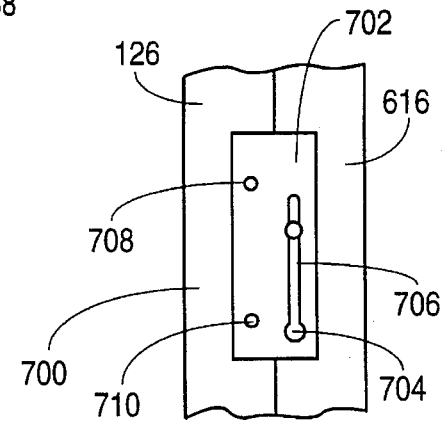
FIG. 7 is a top view of a key hole bracket.

Referring to FIG. 7, a top view of a single piece flat key-hole bracket 700 illustrative of brackets 604 and 606 is shown attached to the underside of chair arm 616 and cross-member 126. The bracket face 702 includes key-hole arch 704 having a radius of approximately ⅛ inches, a channel 706 having a length of approximately 1½ inches, and a width of approximately ⅛ inches. The thickness of bracket face 702 is approximately 1/16 inches. Through holes 708 and 710 have approximately ⅛ inch diameters which are respectively less than the diameters of the heads of screws 608 and 610.

Various other storage assembly embodiments are contemplated within the spirit of this invention of providing a storage assembly as defined by the claims. For example, the pouch may be a solid hinged material that opens and closes with the frame and transverse members. The pouch may be attached to the storage assembly either removably or permanently to the storage assembly with any suitable fastening means such as direct attachment to cross-members with staples or nails or inserting a cross-member through a pouch sleeve prior to attachment of the cross-members to same side frame and transverse members. Other pouch fastening means for removability may be utilized such as velcro.

Additionally, rather than being attached to the base of respective frame support members, transverse members may be pivotally attached to the outside top of respective frame support members and rotate away with a locking hinge attached to the corresponding transverse and frame support members to support an orthogonally oriented open position. The frame support members may be directly attached with fastening means such as a flat key-hole bracket to an object such as a director's chair arm or a director's chair arm and a director's chair seat cross-member. The pouch may be directly attached to the frame support members and storage assembly cross-members may be included for support or eliminated.

Furthermore, the frame support members and transverse members may be respectively aligned rather than offset (as shown in FIG. 4) by attaching a hinge to the bottom of corresponding frame and transverse members and attaching a locking hinge to the inside or outside of the corresponding frame and transverse members. Moreover, a pouch may be directly attached to ends of two frame members and ends of two transverse members, the hinges may be eliminated, and supports added to the suspended pouch to prevent unwanted closing when an extraneous item is placed in the pouch. Also, other mechanical motion limiters may be used such as a bracket attached to at least one frame support member and having a transverse member engage the corresponding cross-member when configured in an open position. Additionally, the pouch may be pulled taut so as to provide a relatively flat platform for retaining objects. Furthermore, the pouch may be replaced by a solid flat platform, for retaining objects, extending between frame members and transverse members supported directly by the frame members and transverse members or supported in conjunction with one or more cross-members.

While the invention has been described with respect to the embodiments and variations set forth above, these embodiments and variations are illustrative and the invention is not to be considered limited in scope to these embodiments and variations. The dimensions and angles described above are approximate and may be scaled or modified to accommodate differing materials and uses. Accordingly, various other embodiments and modifications and improvements not described herein may be within the spirit and scope of the present invention, as defined by the following claims.

What is claimed is:

1. A storage assembly attachable to a chair arm comprising:

a means for retaining objects, the means having first and second sleeves disposed on opposite ends of the retaining means;

a first support means for supporting the retaining means, the first support means having a first cross-member means;

a second support means, pivotally coupled to the first support means, for further supporting the retaining means, the second support means having a second cross-member means wherein the first and second cross-member means include respective conduits having slits extending at least substantially the length of the first and second crosse-member means;

a first rod means removably disposed within the first cross-member conduit and within the first retaining means sleeve;

a second rod means removably disposed within the second cross-member conduit and within the second retaining means sleeve; and a fastening means coupled to one of the first and second support means for fastening the storage assembly to a chair arm.

2. The assembly as in claim 1 wherein the first support means further includes a first pair of substantially parallel frame means coupled to said first cross-member means and a third cross-member means substantially parallel to the first cross-member means and coupled to the first frame means pair, and wherein the second support means further includes a second pair of substantially parallel frame means coupled to the second cross-member means.

3. The assembly as in claim 1 further comprising a brace means for fixing a location of the second support means relative to the first support means.

4. The assembly as in claim 1 wherein the means for retaining objects is a pouch.

5. An apparatus comprising:

a first frame support member;

a second frame support member;

a first transverse member having an end pivotally attached to an end of the first frame support member;

a second transverse member having an end pivotally attached to an end of the second frame support member;

a pouch having a cavity suspended from first and second frame support member ends and first and second transverse member ends, wherein the pouch includes first and second lengthwise sleeves disposed on opposite ends of the pouch;

a first cross-member connected between the first and second frame support members;

a second cross-member connected between the first and second transverse members, wherein the first and second cross-members include respective conduits having slits extending at least substantially the length of the first and second cross-members;

a first rod removably disposed within the first cross-member conduit and within the first pouch sleeve; and a second rod removably disposed within the second cross-member conduit and within the second pouch sleeve.

6. The apparatus as in claim 5 wherein the first frame support member includes first and second ends, the second frame support member includes first and second ends, the first transverse member includes a first end pivotally attached to the first frame support member second end and having a second end, the second transverse member having a first end pivotally attached to the second frame support member second end and having a second end, the apparatus further comprising:

wherein the first cross-member further includes a first end coupled to the first frame support member first end and a second end coupled to the second frame support member first end;

wherein the second cross-member further includes a first end coupled to the first transverse member second end and a second end coupled to the second transverse member second end;

a first brace having a first end coupled to the first frame support member and a second end coupled to the first transverse member;

a second brace having a first end coupled to the second frame support member and a second end coupled to the second transverse member; and a chair arm attachment device coupled to the first and second frame members.

7. The apparatus as in claim 6 wherein the first and second frame support members, the first and second cross-members, and the first and second transverse members are wooden beams.

8. The apparatus as in claim 5 wherein the pouch is cotton.

9. The assembly as in claim 5 wherein the respective conduits are converging arc conduits.

10. The assembly as in claim 5 wherein the first and second rods are elongated cylinders.

11. An assembly attachable to a chair arm comprising:

a first frame support member;

a second frame support member;

a first transverse member having an end pivotally attached to an end of the first frame support member;

a second transverse member having an end pivotally attached to an end of the second frame support member;

an object retainer suspended from first and second frame support member ends and first and second transverse member ends;

a chair arm attachment device coupled to the first frame member a first cross-member having opposite ends respectively attached to ends of the first and second frame support members opposite attached ends of the first and second transverse members;

a second cross-member having opposite ends respectively attached to ends of the first and second transverse members opposite the first and second frame support members;

wherein the first and second cross-members include respective converging arc conduits extending the length of the first and second cross-members and the object retainer includes first and second lengthwise sleeves disposed on opposite ends of the object retainer, the assembly further comprising:

a first dowel rod removably disposed within the first cross-member conduit and within the first object retainer sleeve; and a second dowel rod removably disposed within the second cross-member conduit and within the second object retainer sleeve.

12. The assembly as in claim 11 wherein the first and second frame support members and the first and second transverse members are wood.

13. The assembly as in claim 11 wherein the first transverse member and the first frame support member are pivotally attached with a rivet, and the second transverse means and the second frame support member are pivotally attached with a rivet.

14. The assembly as in claim 11 wherein the object retainer is a cotton pouch.

15. The assembly of claim 11 further comprising a third cross-member having first and second ends respectively coupled to the first ends of the first and second transverse members.

16. The assembly as in claim 11 wherein the first and second transverse members are respectively attached to ends of the first and second frame support members opposite the first and second frame support member ends from which the pouch is suspended.

17. The assembly as in claim 11 further comprising:

a first locking hinge having ends respectively attached to and between ends of the first frame support member and the first transverse member; and a second locking hinge having ends respectively attached to and between ends of the second frame support member and the second transverse member.

18. The assembly as in claim 11 wherein the chair arm attachment device includes a cross-member having ends attached to respective ends of the first and second frame support members, a pair of flat brackets each having a key hole opening, a plurality of through holes, and a plurality of screws inserted through the respective through holes into the cross-member.

* * * * *